US008251393B2

(12) United States Patent
Fremgen et al.

(10) Patent No.: US 8,251,393 B2
(45) Date of Patent: Aug. 28, 2012

(54) CIRCULATION ASSISTING WHEELCHAIR

(75) Inventors: Bonnie Fremgen, Kent, CT (US); Troy E. Atkinson, Mohegan Lake, NY (US); John P. Sochocky, Jr., Clintondale, NY (US)

(73) Assignee: Bonnie Fremgen, LLC, Kent, CT (US)

( * ) Notice: Subject to any disclaimer, the term of this patent is extended or adjusted under 35 U.S.C. 154(b) by 41 days.

(21) Appl. No.: 13/020,923

(22) Filed: Feb. 4, 2011

(65) Prior Publication Data

US 2011/0121535 A1 May 26, 2011

Related U.S. Application Data

(63) Continuation-in-part of application No. 12/251,516, filed on Oct. 15, 2008, now Pat. No. 7,922,187.

(51) Int. Cl.
*A61G 5/10* (2006.01)

(52) U.S. Cl. ..... 280/304.1; 280/250.1

(58) Field of Classification Search ..... 280/304.1, 280/288.4, 250.1; 180/205
See application file for complete search history.

(56) References Cited

U.S. PATENT DOCUMENTS

| | | | | |
|---|---|---|---|---|
| 3,865,220 | A | | 2/1975 | Thompson, Jr. |
| 3,994,509 | A | | 11/1976 | Schaeffer |
| 4,324,414 | A | | 4/1982 | Wilkes |
| 4,523,769 | A | | 6/1985 | Glaser et al. |
| 4,572,501 | A | | 2/1986 | Durham et al. |
| 5,020,815 | A | * | 6/1991 | Harris et al. ..... 280/246 |
| 5,273,304 | A | | 12/1993 | Berkheimer |
| 5,324,060 | A | * | 6/1994 | Van Vooren et al. ..... 280/304.1 |
| 5,362,081 | A | | 11/1994 | Beidler et al. |
| 6,142,914 | A | | 11/2000 | Crawford et al. |
| 6,196,565 | B1 | | 3/2001 | Chubbuck |
| 6,220,615 | B1 | * | 4/2001 | Chubbuck ..... 280/304.1 |
| 6,341,671 | B1 | | 1/2002 | Ebersole |
| 6,648,354 | B2 | | 11/2003 | James |
| 7,036,838 | B2 | | 5/2006 | Leffler |
| 7,118,515 | B2 | | 10/2006 | Kassel et al. |
| 7,293,623 | B2 | | 11/2007 | Berkelmans |
| 2002/0101054 | A1 | | 8/2002 | James |
| 2007/0114750 | A1 | | 5/2007 | Dix et al. |

* cited by examiner

*Primary Examiner* — Tashiana Adams
(74) *Attorney, Agent, or Firm* — McCormick, Paulding & Huber LLP

(57) ABSTRACT

Gentle and substantially linear vertical motion of a wheelchair foot support is expected to assist lower limb circulation for a user with limited leg mobility, reducing risks of clotting or blockage within peripheral blood vessels. Additionally, to whatever extent limb atrophy may be reduced by imposed motion, motion of the foot support may help in maintaining muscle mass and flexibility of ligaments. Accordingly, a circulation assisting wheelchair includes a foot support movably connected to the wheelchair frame by a movable foot support assembly. The movable foot support assembly is connected to a rear wheel of the wheelchair via a drive train, so that normal operation of the wheelchair drives substantially linear vertical oscillating motion of the foot support.

7 Claims, 5 Drawing Sheets

CIRCULATION ASSISTING WHEELCHAIR

CROSS REFERENCE TO RELATED APPLICATIONS

The present application is a continuation-in-part from, and claims priority to, U.S. patent application Ser. No. 12/251,516 entitled "ATROPHY-REDUCING MOVABLE FOOT SUPPORT APPARATUS" filed Oct. 15, 2008 by Dr. Bonnie Fremgen and published Apr. 15, 2010, hereby incorporated herein by reference.

FIELD OF THE INVENTION

The present invention relates generally to wheelchairs and, more particularly, to wheelchairs including apparatus for exercising the legs of wheelchair occupants.

BACKGROUND OF THE INVENTION

Typical wheelchair designs employ a sturdy frame supporting a seat assembly. The seat assembly includes arm rests and push bars to allow the wheelchair to be pushed by an aide. Attached to the rear of the frame is a pair of drive wheels. The drive wheels are typically large diameter wheels attached to a central hub with spokes. Push rims are mounted to the drive wheels to allow the wheelchair occupant to propel the chair using their arms and upper body. A smaller pair of pivoting castor wheels is attached to the front of the frame to provide steerability. Extending down from the lower front of the wheelchair frame is a footrest system to support the lower legs. The footrest system typically includes a pair of bars, one mounted to each side of the frame. Attached to each bar is a footrest, which typically may be pivoted up and out of the way to provide clearance if the occupant so desires. Adjustment mechanisms allow each bar to slide in adjustment relative to the frame to accommodate the differing heights and leg lengths of the wheelchair occupant.

One drawback to existing wheelchairs is that the footrest system, once adjusted for the particular size of the occupant, remains locked in a fixed position. As a result, the occupant's legs are stationary while seated in the wheelchair. Over extended periods of time, a wheelchair occupant who is not able to move their legs on their own may develop atrophy in the leg muscles and contracture of the leg joint ligaments. Moreover, prolonged leg immobility substantially increases risks of blood clotting (venous thrombosis) or arterial blockage (peripheral arterial disease). Either of these problems with blood circulation can cause death either incrementally via necrosis and infection, which may be averted by amputation; or, more immediately, via dislodgement of a clot or blockage that subsequently blocks a cardiac, pulmonary, or cranial artery.

Efforts have been made to prevent muscle atrophy and contractures, as well as circulatory deficiencies, by providing for continuous or periodic motion of a wheelchair occupant's legs. For example, one prior art solution is provided by a wheelchair cycle apparatus that includes a frame to which is attached a connecting device for connecting the frame to a wheelchair. A drive wheel and driven wheel are attached to the frame. A pair of pedals are attached to either the drive wheel or the driven wheel depending upon whether the user can move his/her own legs. A chain connects the drive wheel to the driven wheel. The wheelchair cycle apparatus may be connected to the frame of a wheelchair to produce a wheelchair assembly that enables a wheelchair occupant to exercise his/her own legs while seated in the wheelchair. However, it is believed difficult to keep a user's feet connected with the revolving pedals in cases where the user's legs are only passively mobile (i.e. for paraplegic wheelchair users, or for those who have suffered less permanent injuries such as stroke, knee or hip replacement, or bone fracture). Possibilities of having feet slip off the revolving pedals, or improper modes of keeping feet on the pedals, present a risk of injury to the feet and legs with consequent risks of infection.

As another example, a wheelchair may be provided with pivoting leg rests. The wheelchair may include a drive assembly linking the pivoting leg rests to the rear wheels, such that a user seated in the wheelchair can propel the chair forward by repeated pivoting motions of the user's lower legs about their knee joints. However, such a drive assembly is usable only by a wheelchair user with actively movable legs. A user with only passively mobile legs cannot utilize the drive assembly.

Thus, a need remains for a wheelchair apparatus that will reliably maintain circulation in the passively mobile or weakened legs of a wheelchair user.

SUMMARY OF THE INVENTION

It is one object of the present invention to provide for use with a wheelchair an apparatus that produces substantially linear vertical oscillating motion of a movable foot support of the wheelchair. Such apparatus is expected to provide superior results for maintenance of circulation in a wheelchair user's legs. In particular, the substantially linear oscillating motion, with accelerations at each end of the motion pathway, is expected to enhance maintenance circulation over what is provided by known devices.

According to the present invention, a wheelchair is provided with a movable foot support assembly that helps to maintain leg circulation for users with limited leg mobility.

In some embodiments of the present invention, a wheelchair is provided with a movable foot support assembly that is driven in substantially linear vertical oscillating motion by rotation of a rear wheel of the wheelchair.

These and other objects, features and advantages of the present invention will become more apparent in light of the following detailed description of best mode embodiments thereof as illustrated in the accompanying drawings.

DETAILED DESCRIPTION OF THE DRAWINGS

Figure 1:
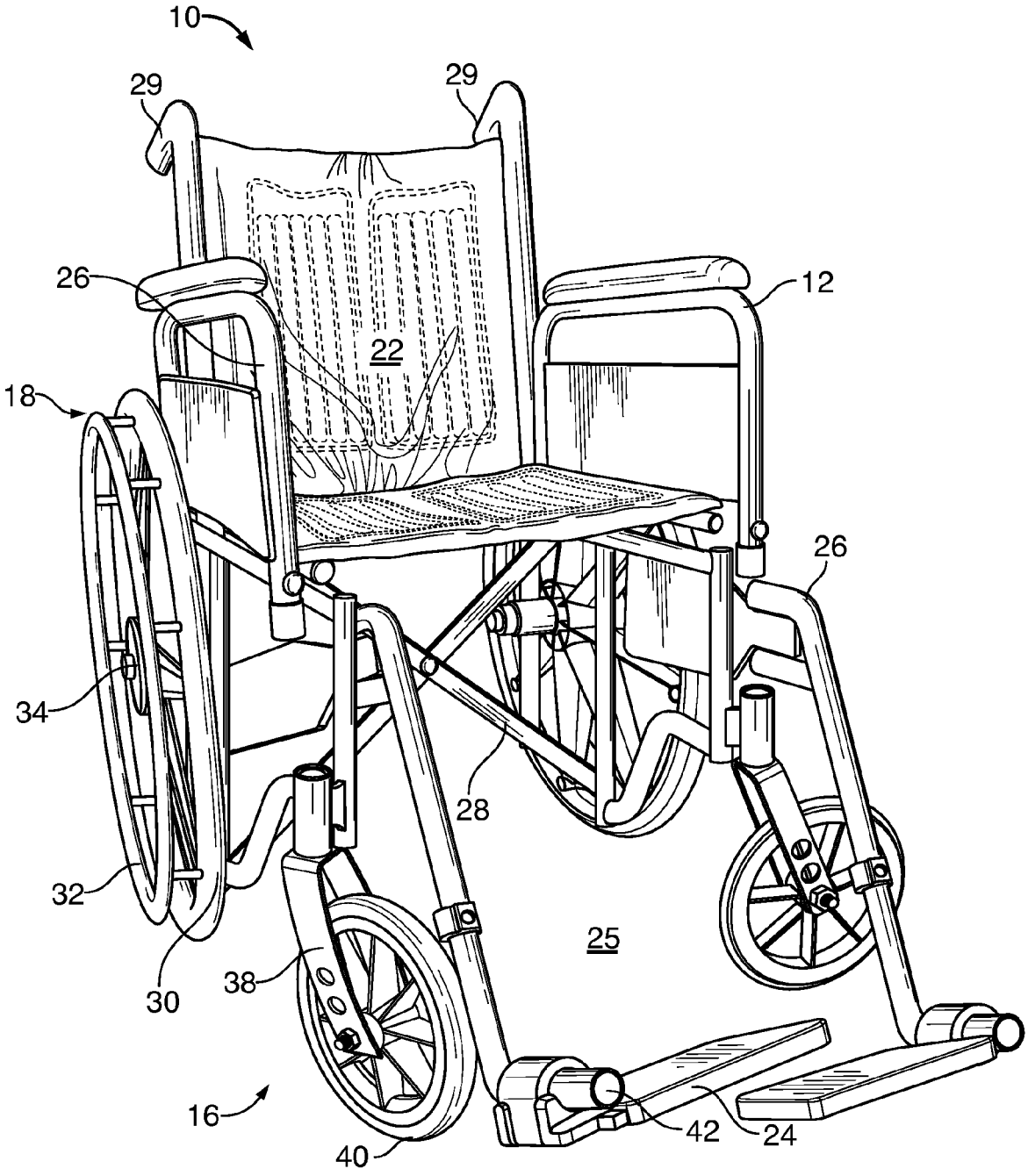
FIG. 1 shows a simplified perspective view of a conventional wheelchair as known in the prior art.

Referring to FIG. 1, one embodiment of a conventional wheelchair 10 includes a frame 12, front caster assemblies 16 pivotally mounted to the frame 12, rear wheel assemblies 18 rotatably mounted to the frame 12, and a seat assembly 22 and footrests 24 that are fixedly mounted to the frame 12. The front caster assemblies 16 and rear wheel assemblies 18 support the frame 12 upon a traveling surface 25.

The frame 12 includes side frames 26 joined by crossbars 28. The frame 12 also includes handles 29, which can be utilized for pushing the wheelchair 10.

Each rear wheel assembly 18 conventionally includes a drive wheel 30 and a push rim 32, which are radially connected to enable a wheelchair occupant to propel the chair using their arms and upper body. The drive wheel 30 is radially connected to a hub 34. For rotary motion of the rear wheel assembly 18, the hub 34 is rotatably mounted to the side frame 26. The drive wheel 30 typically includes a metal or hard polymer rim on which is mounted a soft polymer tire. The push rim 32 typically includes a metal or hard polymer rail extending circumferentially, and optionally includes a soft grip mounted on the rail.

Each of the front caster assemblies 16 includes a wheel bracket 38 that is pivotally connected to the side frame 26. Each of the front caster assemblies 16 also includes a front wheel 40 that is rotatably mounted within the wheel bracket 38. Accordingly, the front wheel 40 can freely swivel to permit steering the wheelchair 10 without wheel skid.

The seat assembly 22 includes conventional elements for supporting the wheelchair occupant such as a seat back supported between upper vertical structural members of the side frames 26, arm rests supported on upper horizontal structural members of the side frames 26, and a sling seat that is supported between the side frames. The elements of the seat assembly 22 that extend between the side frames 26 typically are made of fabric or flexible polymer to permit collapsing and deploying motion of the side frames 26.

The footrests 24 are provided at the front of the frame 12 to support the feet and lower legs of the wheelchair occupant. Each footrest 24 typically is pivotally supported on a bar 42 that is rigidly mounted to one of the side frames 26. The footrests 24 typically may be pivoted up and out of the way around the bars 42 for ease of entering or leaving the wheelchair 10. However, once lowered for use by the wheelchair occupant, the footrests are fixedly mounted to the frame 12. As a result, the occupant's legs are stationary while seated in the wheelchair 10, leading to the problem of atrophy discussed above.

Figure 2:
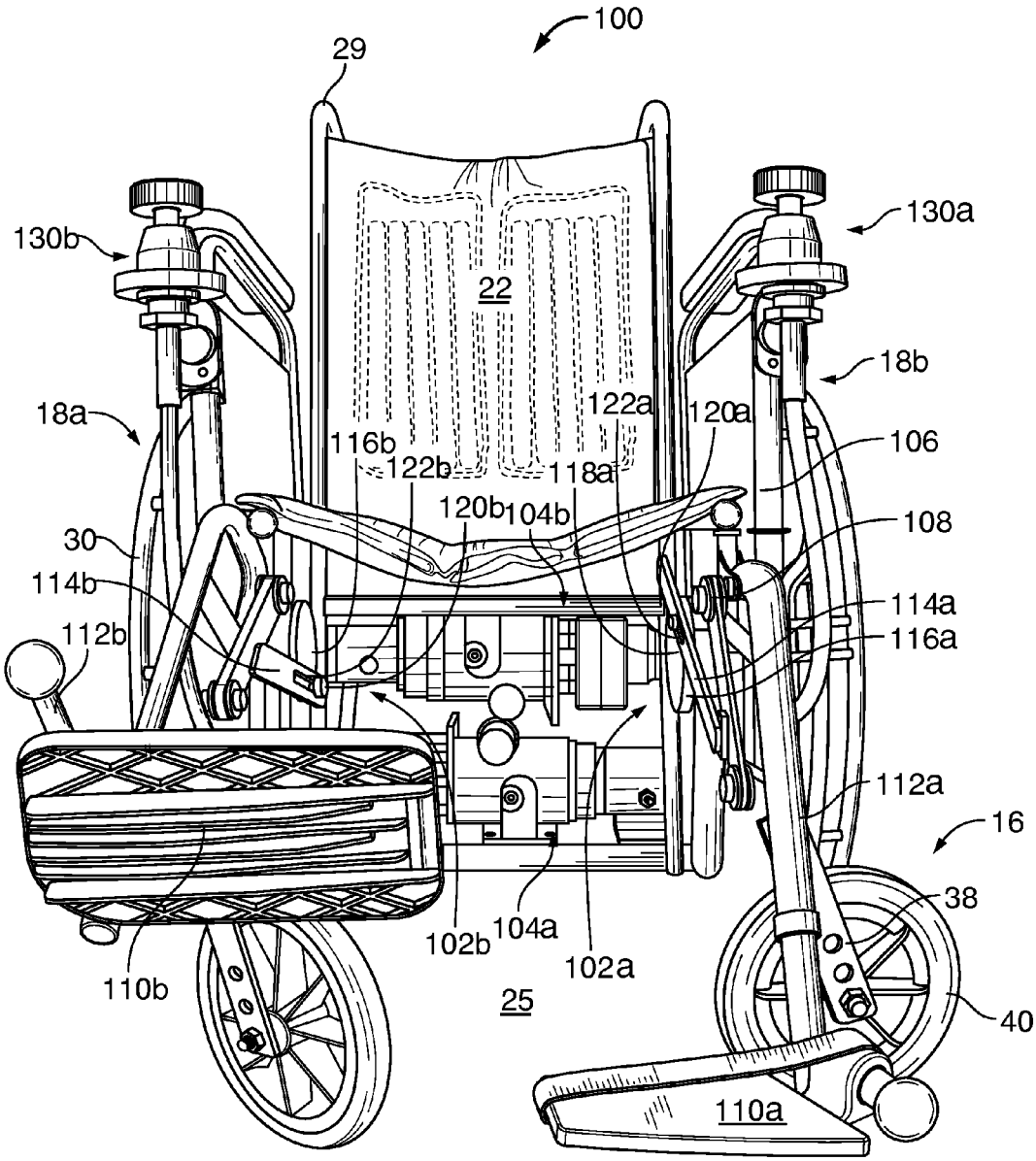
FIG. 2 shows a front perspective view of a wheelchair with a first movable foot support assembly, according to an embodiment of the present invention.

Referring to FIGS. 2-5, wherein matching components are given matching numbers to those shown in FIG. 1, in one embodiment of the present invention a wheelchair 100 includes at least one movable foot support assembly 102 that is driven by a rear wheel assembly 18 via a corresponding drive train 104. As shown in FIG. 2 a left-side movable foot support assembly 102*a* is movably mounted to a side frame 106 of the wheelchair 100 at a pivot 108. A lower drive train 104*a* connects the left side foot support assembly 102*a* to a right rear wheel assembly 18*a*. Similarly, a right-side movable foot support assembly 102*b* is connected by an upper drive train 104*b* to a left rear wheel assembly 18*b*. The drive trains 104 may be mounted to either or to both side frames 106 by conventional methods such as, for example, by brackets or welding. In the embodiment shown in FIGS. 2-5, the drive trains 104 are hidden by protective covers 109.

Each movable foot support assembly 102 includes a footrest 110 pivotally mounted on a bar 112. Whereas the conventional wheelchair 10, shown in FIG. 1, has a bar 42 rigidly mounted to a side frame 26, in the embodiment of the invention shown in FIGS. 2-4, each bar 112 is pivotally mounted to the side frame 106 at the associated pivot 108, and is movable about the pivot 108 by way of a crank arm 114. The crank arm is moved to oscillate about the pivot 108 by rotation of a cam wheel 116, which is rotatably mounted to the side frame 106 on a shaft 118 (shown in FIG. 3). Each cam wheel 116 carries a pin 120 slidingly engaged within a slot 122 formed in the crank arm 114. Thus, rotation of the cam wheel 116 drives the crank arm 114 and the bar 112 to reciprocate swingingly around the pivot 108. Each cam wheel 116 is driven by the opposite-side rear wheel assembly 18 via one of the drive trains 104, as further discussed below.

Figure 3:
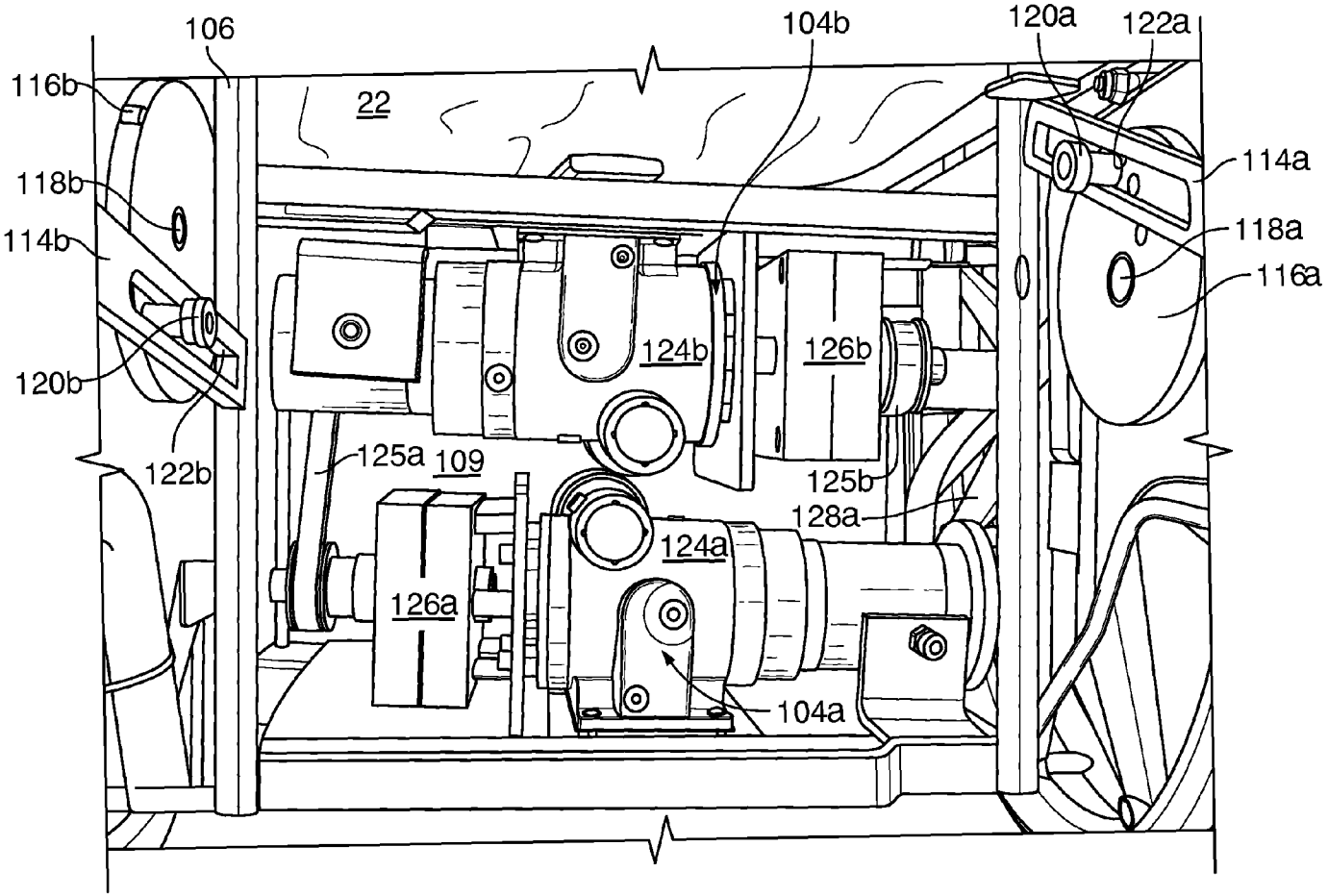
FIG. 3 shows a detailed view of a drive train of the wheelchair shown in FIG. 2.
Figure 4:
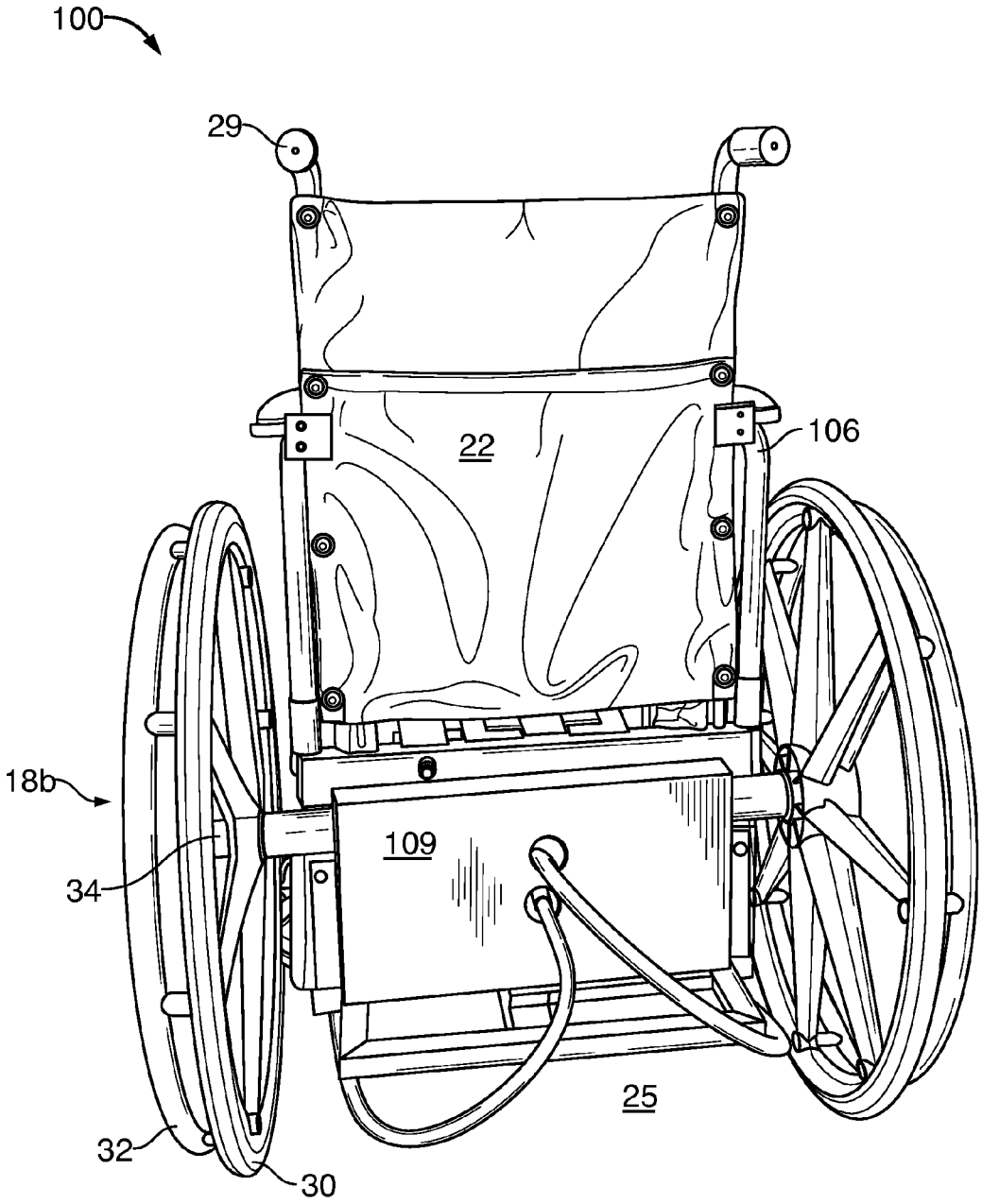
FIG. 4 shows a rear perspective view of the wheelchair shown in FIG. 2.
Figure 5:
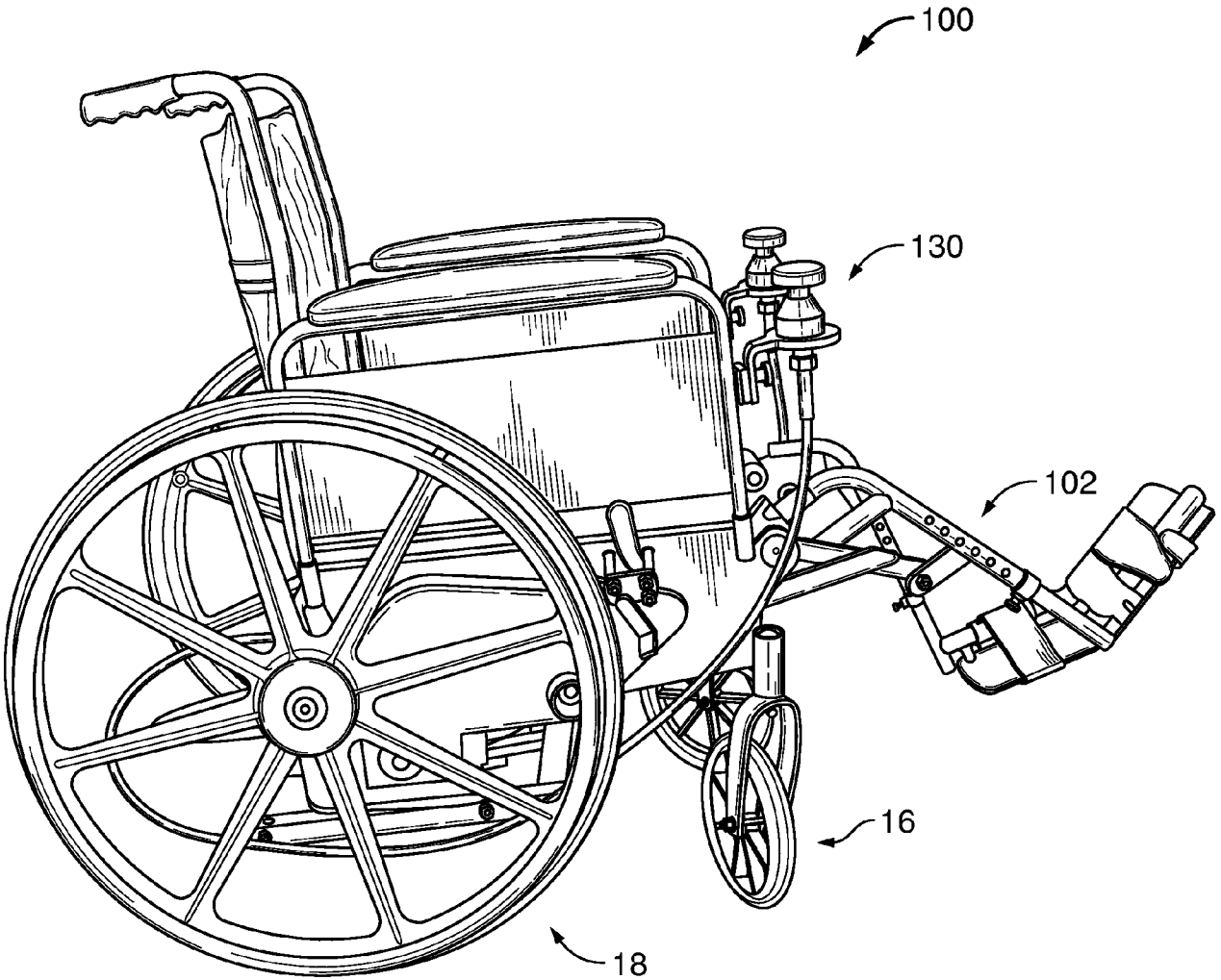
FIG. 5 shows a side view of the wheelchair shown in FIG. 2.

Referring specifically to FIG. 3, each drive train 104 includes an infinite-variable-speed transmission 124 that is driven from one of the rear wheel assemblies 18 via a fixed-ratio mechanical gearbox 126. In FIG. 3 it can be seen that the transmission 124*a* of the lower drive train 104*a* is driven from the hub 34*a* of the right rear wheel assembly 18*a* via a pair of pulleys and a belt 125*a*, while the transmission 124*b* of the upper drive train 104*b* is driven from the hub 34*b* of the left rear wheel assembly 18*b* via a pair of pulleys and a belt 125*b*. The output shaft (not shown) of each drive train 104 drives the shaft 118 of one of the cam wheels 116 via a belt or a chain 128. Thus, each drive train 104 transfers torque and speed from one of the rear wheel assemblies 18 to the opposite side movable foot support assembly 102.

In each drive train 104 as shown in FIGS. 2-5, a Plaromaster™ hydraulic variable speed transmission is used in combination with a 7:1 fixed ratio gearbox. Each variable-speed transmission may be adjusted by an associated planetroll™ HRS shifter 130 to select any of at least twelve (12) different gear ratios between each rear wheel assembly 18 and the corresponding cam wheel 116. Each shifter 130 may be mounted on one of the side frames 106, either at the front or the rear of the wheelchair 100, for adjustment either by a wheelchair user or by an attendant.

In use, the wheelchair 100 is propelled forward at a normal walking pace, for example by the wheelchair occupant gripping and pushing the rear wheel rims 32 or by an attendant using the handles 29. Forward or rearward rotation of each rear wheel assembly 18 drives the corresponding movable foot support assembly 102 via the corresponding drive train 104, according to the gear ratio selected using the associated shifter 130.

It is expected that, for typical wheelchair occupants, gently oscillating motion of a foot support will result in improved maintenance of circulation, reduced clotting, reduced rates of leg muscle atrophy and ligament contracture compared to conventional non-moving wheelchair foot supports, and also will result in superior longevity of knee joint tissue compared to the results of pivoting or cyclic leg motions taught in the prior art. For example, gentle oscillating motion may be such that velocity of the footrest 110 does not exceed about 1 m/s, with peak acceleration of no more than about 1 g at the footrest. Preferably, locations of the pivot 108, the cam wheel 116, the pin 120 and the slot 122 may be chosen such that motion of the footrest 110 is substantially vertical.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention should not be limited to the particular embodiments disclosed in the above-detailed description, and that the following claims should be given their full reasonable scope.

What is claimed is:

1. A wheelchair comprising:

front and rear wheel assemblies;

a frame supported on said front and rear wheel assemblies;

a movable foot support assembly mounted on said frame and including a foot support; and a shiftable drive train mounted to the frame and operatively connecting said movable foot support to one of said rear wheel assemblies, wherein rotation of the one of said rear wheel assemblies is transferred via said shiftable drive train, according to complementary torque and speed ratios selected from a pre-determined range of ratios, to cause substantially linear oscillating motion of the foot support of said movable foot support assembly.

2. The wheelchair as claimed in claim 1, further comprising:

a shifter mounted to the frame in a pre-selected location, and operatively connected with said shiftable drive train for selecting complementary torque and speed ratios from the pre-determined range of ratios, wherein the pre-selected location is a forward location for use by a wheelchair occupant, or a rearward location for use by a wheelchair attendant.

3. The wheelchair as claimed in claim 1, wherein said movable foot support assembly is mounted to said frame at a pivot defining a pivot axis substantially perpendicular to the frame and offset parallel from the rear wheel axis, and at a journal defining a journal axis substantially perpendicular to the frame and offset parallel from the pivot axis and from the rear wheel axis.

4. The wheelchair as claimed in claim 3, wherein said movable foot support assembly includes a bar having proximal and distal ends joined by a middle segment, the proximal end of the bar being pivotally connected to the pivot of the frame and the foot support being carried at the distal end of the bar, a crank arm having driven and driving ends, the driving end of the crank arm being pivotally joined to the middle segment of the bar, the crank arm having a slot opened along it near the driven end, and a cam wheel rotatably mounted to the journal of the frame and including a cam pin, the cam pin being engaged into the slot of the crank arm, such that rotation of the cam wheel causes pivoting motion of the bar about the pivot of the frame.

5. The wheelchair as claimed in claim 4, wherein the cam wheel is driven from said shiftable drive train via a flexible member.

6. The wheelchair as claimed in claim 4, wherein the cam pin is slidingly engaged into the slot of the crank arm.

7. The wheelchair as claimed in claim 1, wherein the substantially linear oscillating motion is substantially vertical.

* * * * *